US012297514B2

(12) United States Patent
Diaz Gonzalez et al.

(10) Patent No.: US 12,297,514 B2
(45) Date of Patent: May 13, 2025

(54) HIGH STRENGTH HOT ROLLED STEEL HAVING EXCELLENT SCALE ADHESIVNESS AND A METHOD OF MANUFACTURING THE SAME

(71) Applicant: ArcelorMittal, Luxembourg (LU)

(72) Inventors: Eva Diaz Gonzalez, Deinze (BE); Lieven Bracke, Sinaai (BE); Tom Waterschoot, Lokeren (BE); Joost Destrycker, Zele (BE)

(73) Assignee: ArcelorMittal, Luxembourg (LU)

( * ) Notice: Subject to any disclaimer, the term of this patent is extended or adjusted under 35 U.S.C. 154(b) by 959 days.

(21) Appl. No.: 17/278,085

(22) PCT Filed: Sep. 25, 2019

(86) PCT No.: PCT/IB2019/058125

§ 371 (c)(1),
(2) Date: Mar. 19, 2021

(87) PCT Pub. No.: WO2020/065549

PCT Pub. Date: Apr. 2, 2020

(65) Prior Publication Data

US 2021/0348245 A1 Nov. 11, 2021

(30) Foreign Application Priority Data

Sep. 25, 2018 (WO) ..... PCT/IB2018/057384

(51) Int. Cl.

| | |
|---|---|
| ***C21D 8/00*** | (2006.01) |
| ***C21D 6/00*** | (2006.01) |
| ***C21D 6/04*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C21D 8/0226* (2013.01); *C21D 6/004* (2013.01); *C21D 6/005* (2013.01); *C21D 6/008* (2013.01); *C21D 9/46* (2013.01); *C22C 38/001* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/005* (2013.01)

(58) Field of Classification Search

CPC ..... C07K 16/44; C07K 2317/55; C07K 2317/76; C07K 2317/56; C07K 2317/565; A61P 7/04; A61P 39/02; A61P 7/02; A61K 2039/505; A61K 2039/54; A61K 2039/545; A61K 31/616; A61K 31/519; A61K 39/39583; A61K 2039/55

See application file for complete search history.

(56) References Cited

U.S. PATENT DOCUMENTS

| | | | |
|---|---|---|---|
| 2009/0269578 | A1 | 10/2009 | Takeda et al. |
| 2010/0059149 | A1 | 3/2010 | Yokoi et al. |
| 2013/0272914 | A1 | 10/2013 | Takeda et al. |
| 2014/0242414 | A1 | 8/2014 | Minami et al. |
| 2016/0017448 | A1 | 1/2016 | Masumoto et al. |
| 2017/0283901 | A1 | 10/2017 | Hu et al. |
| 2018/0044754 | A1 | 2/2018 | Azuma et al. |

FOREIGN PATENT DOCUMENTS

| | | | |
|---|---|---|---|
| CN | 1888120 | A | 1/2007 |
| CN | 101570817 | A | 11/2009 |
| CN | 103103458 | A | 5/2013 |
| CN | 103314125 | A | 9/2013 |
| CN | 105074034 | A | 11/2015 |

(Continued)

OTHER PUBLICATIONS

See Search Report of PCT/IB2019/058125 dated Oct. 21, 2019.

*Primary Examiner* — Anthony M Liang
*Assistant Examiner* — Danny N Kang
(74) *Attorney, Agent, or Firm* — Davidson Kappel LLC

(57) ABSTRACT

A hot rolled steel product having a composition including in percentage by weight: 0.06%≤C≤0.18%, 0.01%≤Ni≤0.6%, 0.001%≤Cu≤2%, 0.001%≤Cr≤2%, 0.001%≤Si≤0.8%, 0%≤N≤0.008%, 0%≤P≤0.03%, 0%≤S≤0.03%, 0.001%≤Mo≤0.5%, 0.001%≤Nb≤0.1%, 0.001%≤V≤0.5%, 0.001%≤Ti≤0.1% and one or more following optional elements 0.2%≤Mn≤2%, 0.005%≤Al≤0.1%, 0%≤B≤0.003%, 0%≤Ca≤0.01%, 0%≤Mg≤0.010% the remainder composition being composed of iron and unavoidable impurities caused by processing, such product having a tertiary scale layer including, in area fraction, a total amount of at least 50% of magnetite and ferrite wherein ferrite is at least 25%, 0% to 50% of wustite, and 0% to 10% of hematite, such scale layer having a thickness between 5 microns and 40 microns.

16 Claims, No Drawings

(56) References Cited

FOREIGN PATENT DOCUMENTS

| | | | | |
|---|---|---|---|---|
| CN | 106048406 | A | | 10/2016 |
| CN | 107427889 | A | | 12/2017 |
| JP | H0673504 | A | | 3/1994 |
| JP | H07207339 | A | | 8/1995 |
| JP | H10158734 | A | | 6/1998 |
| JP | H1119702 | A | | 1/1999 |
| JP | H1143724 | A | | 2/1999 |
| JP | H1177115 | A | | 3/1999 |
| JP | 2004-346416 | | | 12/2004 |
| JP | 2004346416 | A | * | 12/2004 |
| JP | 2007039811 | A | | 2/2007 |
| JP | 2008214650 | A | | 9/2008 |
| JP | 2008248384 | A | | 10/2008 |
| JP | 2011089166 | A | * | 5/2011 |
| JP | 2012 020309 | A | | 2/2012 |
| JP | 2012021192 | A | | 2/2012 |
| JP | 2013237101 | A | | 11/2013 |
| JP | 2014-031537 | | | 2/2014 |
| JP | 2014218692 | A | | 11/2014 |
| JP | 2016166388 | A | | 9/2016 |
| WO | WO2013018741 | A1 | | 2/2013 |
| WO | WO2017183133 | A1 | | 10/2017 |

* cited by examiner

HIGH STRENGTH HOT ROLLED STEEL HAVING EXCELLENT SCALE ADHESIVNESS AND A METHOD OF MANUFACTURING THE SAME

The present invention relates to a hot rolled product with excellent scale adhesiveness suitable for use in manufacturing of large industrial machines such as cranes, trucks and other earth movers. In particular, the present invention possesses excellent scale adhesiveness with corrosion resistance and a method of manufacturing the same.

BACKGROUND

Hot rolled steel is used in for manufacturing of steel parts for construction and heavy industry machinery such as parts of cranes, trucks and earth movers. But in recent years, there has been an increased emphasis on carbon footprint from a view point of global environment conservation. There also has been an increase in harshness of the working environments. Hence, there lies a need for these machineries such as cranes and trucks to perform efficiently as per industrial standards while resisting harsh working environments especially in terms of corrosion resistance; consequently the development of steel having corrosion resistance and acceptable mechanical properties is mandated.

Intense research and development efforts have been made to develop a steel product that has adequate corrosion resistance which can keep up with the harsh working environment while keeping up with the industrial standards.

Therefore, hot rolled steel having a tertiary scale have been developed to offer a good balance between mechanical properties and utility in the harsh industrial environment while adhering to the strict environmental standards. Such tertiary scale is formed during hot mill processing, after roughing, once secondary scale is removed. Scale formed during the heating of steel to rolling temperatures in the reheating furnace is known as primary scale.

JP2014-031537 discloses a hot rolled steel plate containing, by mass %, C: 0.01 to 0.4%, Si: 0.001 to 2.0%, Mn: 0.01 to 3.0%, P: 0.05% or less, S: 0.05% or less, Al: 0.3% or less, N: 0.01% or less and the balance Fe with inevitable impurities, and has a thickness of scale formed on a surface of the steel plate of 20 μm or less, a ratio of a contact length with a ferrite of the steel plate and magnetite to the contact length with the ferrite and scale in the rolling direction of 80% or more and an average particle diameter of magnetite of 3 μm or less, this hot rolled product has holding time between 400° C. and 450° C. for 90 minutes or more which is very energy intensive and further it has high amount of Hematite which is detrimental for scale adhesion.

JP2004-346416 discloses a hot-rolled steel plate with scale having reproducibly and reliably improved adhesiveness, even when the steel material has particularly a high Mn content. The hot-rolled steel plate has a scale layer on the surface, which comprises magnetite, contains 0.3% or less $MnFe_2O_4$ by volume fraction and 1.0% or less (Fe, Mn) O by volume fraction, and has a residual compression stress of 400 MPa or lower. But the presence of $MnFe_2O_4$ reduces the scale adhesion even if magnetite content is high

SUMMARY OF THE INVENTION

It is an object of the present invention to make available hot rolled steel products with excellent scale adhesiveness that simultaneously have:

- an improved corrosion resistance less than 20% of red dust,
- a scale adhesiveness equal to or greater than 60% reflectivity.
- a surface cleanliness greater than or equal to 65% reflectivity, Preferably, such steel has a good suitability for forming, in particular for rolling and a good weldability and cutting.

The present invention provides a hot rolled steel product having a composition comprising in percentage by weight:

0.06%≤Carbon≤0.18%
0.01%≤Nickel≤0.6%
0.001%≤Copper≤2%
0.001%≤Chromium≤2%
0.001%≤Silicon≤0.8%
0%≤Nitrogen≤0.008%
0%≤Phosphorus≤0.03%
0%≤Sulfur≤0.03%
0.001%≤Molybdenum≤0.5%
0.001%≤Niobium≤0.1%
0.001%≤Vanadium≤0.5%
0.001%≤Titanium≤0.1% and can contain one or more of the following optional elements 0.2%≤Manganese≤2%
0.005%≤Aluminum≤0.1%
0%≤Boron≤0.003%
0%≤Calcium≤0.01%
0%≤Magnesium≤0.010% the remainder composition being composed of iron and unavoidable impurities caused by processing, such product having a tertiary scale layer comprising, in area fraction, a total amount of at least 50% of magnetite and ferrite wherein ferrite is at least 25%, 0% to 50% of wustite, and 0% to 10% of hematite, such scale layer having a thickness between 5 microns and 40 microns.

Another object of the present invention is also to make available a method for the manufacturing of these products that is compatible with conventional industrial applications while being not too sensitive with respect to some small variations of the manufacturing parameters.

The present invention provides a method of production of a hot rolled steel product comprising the following successive steps:

- providing a steel composition as above;
- reheating said semi-finished product to a temperature between 1000° C. and 1280° C.;
- rolling the said semi-finished product completely in the austenitic range wherein the hot rolling finishing temperature shall be greater than or equal to 800° C. to obtain a hot rolled steel sheet with thickness between 2 mm and 20 mm;
- cooling the hot rolled steel sheet at a cooling rate of 2 to 30° C./s to a coiling temperature less than or equal to 650° C.; and coiling the said hot rolled sheet;
- cooling the said hot rolled sheet to room temperature at a cooling rate less than 2° C./s to obtain a hot rolled steel product.

DETAILED DESCRIPTION

The steel according to the invention presents a specific composition which will be detailed.

Carbon is present in the steel of the present invention between 0.06% and 0.18%. Carbon is present to secure certain tensile strength. However, when carbon is less than 0.06%, such a containing effect is insufficient. On the other hand, when carbon is more than 0.18%, a base metal and a weld heat affected zone are degraded in toughness, and weldability is significantly degraded. Therefore, the content of carbon is limited to be 0.06 to 0.18%.

Nickel is present in the steel of the present invention between 0.01% and 0.6%. Nickel has a function of improving toughness and hardenability of steel substrate. However, nickel also plays an important role in forming adhesive scale a minimum of 0.01% of nickel is required for adhesion of scale when the content of nickel exceeds 0.6%, economic efficiency is reduced. Preferable limits for the nickel content is between 0.01% and 0.3%.

Copper is present in the steel of the present invention between 0.001% and 2%. Copper has a function of improving strength by solution hardening and precipitation hardening for the steel substrate. Copper has a strong influence on scale formation therefore a minimum of 0.005% of copper is required to ensure a minimum amount of scale on the steel surface and to impart scale adhesion. However, when the content of copper exceeds 2%, cracking in hot working tends to occur during heating a steel billet or welding. Therefore, when copper is added, the content is limited to be 2% or less. Copper content is preferably present between 0.001% and 0.5%.

Chromium is present in the steel of the present invention between 0.001% and 2%. Chromium has a function of improving strength and toughness, and is excellent in imparting high temperature strength property. Therefore, when a steel material is intended to be increased in strength, chromium is actively added, and particularly, chromium of 0.01% or more is preferably added to obtain a property of tensile strength for steel substrate. Chromium is advantageous for adhesion of scale in particular to wustite as chromium have an anchoring effect on wustite. However, when the content of chromium exceeds 2%, weldability is degraded. Therefore, when chromium is added, the content is limited to be 2% or less. Preferable limit for chromium for the present invention is between 0.01% and 0.3%.

Silicon is present in the steel of the present invention between 0.001% and 0.8%. Silicon is contained as a deoxidizing agent in a steel making stage and as an element for improving strength. However, when silicon is less than 0.01%, such a containing effect is insufficient. On the other hand, when silicon is more than 0.8% increases formation of fayalite which impact the homogeneity of the scale. Silicon can be preferably between 0.01% and 0.5% and more preferably between 0.01% and 0.4%.

Nitrogen is present in the steel of the present invention between 0% and 0.008%. Nitrogen is added because it refines a structure by forming nitrides with titanium or the like and thus improves toughness of the base metal and the weld heat affected zone. When nitrogen is added less than 0.0005%, the effect of refining a structure is not sufficiently provided, and on the other hand, when nitrogen is added more than 0.008%, the amount of dissolved nitrogen is increased, and therefore toughness of the base metal and the weld heat affected zone is degraded. Therefore, the preferred content of nitrogen is limited to be 0.0005 to 0.008%.

Each of phosphorus and Sulphur are impurity elements, and can be present up to 0.03% as above this amount sound base metal and a sound welding joint cannot be obtained. Therefore, the content of each of phosphorus and Sulphur is limited to be 0.03% or less. However, for sulphur, it is preferably specified to be $0.0004\% \leq S \leq 0.0025\%$ and for phosphorus preferable limits is between 0% and 0.02%.

Molybdenum is present in the steel of the present invention between 0.001% and 0.5%. Molybdenum has a function of improving corrosion resistance of the scale and strength of the steel, in addition, it improves the scale adhesiveness. When molybdenum is added more than 0.5%, economic efficiency is reduced. Therefore, when molybdenum is added, the content is limited to be 0.001 to 0.3%.

Niobium improves strength as a micro-alloying element, in addition, traps diffusible hydrogen by forming carbides, nitrides, or carbon-nitrides, so that improves the delayed fracture resistance property. When niobium is added less than 0.001%, such an effect is insufficient, and on the other hand, when it is added more than 0.1%, toughness of a weld heat affected zone is degraded. Therefore, when niobium is added, the content is limited to be 0.001 to 0.1%.

Vanadium improve the strength of the steel as a micro alloying element, by trapping diffusible hydrogen by forming carbides, nitrides, or carbon-nitrides. When vanadium is added less than 0.001% such an effect is insufficient, and on the other hand, when it is added more than 0.5%, toughness of a weld heat affected zone is degraded. Therefore, when vanadium is added, the content is limited to be 0.001 to 0.5%. Preferable limit for vanadium is between 0.001% and 0.3%.

Titanium is present in the steel of the present invention between 0.001% and 0.1%. Titanium for nitrides to impart strength to the steel of the present invention. However, when titanium is added less than 0.001%, such an effect is insufficient, and on the other hand, when it is added more than 0.1%, toughness of steel is degraded. Therefore, when titanium is added, the content is limited to be 0.001 to 0.1%.

Manganese is contained to secure certain tensile strength. However, when manganese is less than 0.2%, such a containing effect is insufficient. On the other hand, when manganese is more than 2% weldability is significantly degraded. Manganese content of the present invention aids in formation of wustite and its stabilization in the scale thereby improving scale adhesion. But when the content of manganese is more than 2% $MnFe_2O_4$ forms which is detrimental for scale adhesion hence the preferable limit of manganese for the present invention is 0.2% and 1.8% and more preferably between 0.5% and 1.5%.

Aluminum is an optional element for the present invention and may be present between 0.005% and 0.1%. Aluminum is added as a deoxidizing agent, in addition, has an effect on refinement of the steel of present invention. However, when aluminum is less than 0.005%, such a containing effect is insufficient. On the other hand, when aluminum is contained more than 0.1%, surface cleanliness and surface quality of the steel deteriorates. Therefore, the content of aluminum is limited to be 0.005 to 0.1%.

Boron is an optional element for the steel of the present invention and present in the steel between 0% and 0.003%. Boron has a function of improving hardenability. However, when the content of boron exceeds 0.003%, toughness is degraded. Therefore, when boron is added, the content is limited to be 0.003% or less.

Calcium is an optional element and is used for control of sulfide based inclusions. However, when calcium is added more than 0.01%, reduction in cleanliness is caused. Therefore, when calcium is added, the content is limited to be 0.01% or less.

Magnesium is an optional element and is used for improving weldability of steel and is limited to an amount of 0.010%.

The scale of present invention is a tertiary scale which develops on the steel strip surface during cooling after hot rolling as well as during coiling and cooling after coiling till 450° C. and have a thickness between 5 microns and 40 microns. The scale comprises ferrite and magnetite and can optionally contain hematite and wustite. Specific function and significance of all the constituents are explained herein for a thought through understanding of the present invention.

Initially an oxide layer of wustite is formed due to the abundance of oxygen available after finishing rolling, wustite forms adjacent to steel substrate whereas hematite layer forms above it. But after coiling, the access to oxygen is limited hence wustite get consumed and reacts with Iron to form two distinct oxide layers:

a magnetite layer dispersed with ferrite adjacent to steel substrate and a wustite oxide layer just above it is formed.

By controlling the thickness and compositions of this scale, targeted mechanical and in use properties may be achieved. The scale of the present invention comprises a total amount of magnetite and ferrite more than 50% by area fraction, 0% and 50% of wustite and up to 10% maximum of hematite Magnetite and ferrite are cumulatively present in the tertiary scale in an amount of 50% or more. In a preferred embodiment, magnetite and ferrite cumulated amounts are 70% or more and the magnetite content is more than 30%. Magnetite oxide scale layer is formed adjacent to steel substrate which forms during coiling till a temperature 450° C. In this magnetite layer, ferrite is dispersed and due to the presence of these particles the magnetite layer imparts adhesion to the scale. The presence of magnetite in the tertiary scale is shown in FIG. 1 wherein the presence of magnetite is shown with a Ferrite dispersed in it. Ferrite is present at least 25% in the tertiary scale of the present invention. Ferrite has a BCC structure and its hardness is generally between 75 BHN and 95 BHN. Ferrite is dispersed in the magnetite layer and impart the scale adhesion property this is also sown in FIG. 1. Ferrite form during the decomposition process of wustite into magnetite as during this reaction Iron of the steel substrate reacts with wustite due to the lack of oxygen and forms magnetite and a Ferrite.

Wustite can be present between 0% and 50% of in the scale of present invention. Wustite is the softest iron rich oxide phase with a formula FeO. Wustite has an isometric-hexoctahedral crystal system with hardness between 5 to 5.5 on Mohs scale while wustite is ductile at high temperature therefore assists during welding and cutting operations but at lower temperature it is very hard and stable which impart the oxide layer of present invention abrasive as well as corrosion resistance. The presence of wustite in excess of 50% deteriorates the adhesion and corrosion resistance properties of the scale of present invention.

Hematite can be present in an amount of 0% to 10% in the scale of present invention. This constituent, when present, generally constitutes the topmost layer of the scale. The hematite is not intended as a constituent of the present invention but can due to the processing parameters. It does not impart any impact up to 10% but above 10% it is detrimental for the adhesion of the scale of present invention.

The steel product according to the invention can be produced by any suitable process. However, it is preferred to use the process described hereunder.

Casting of a semi-finished product can be done in form of ingots or in form of thin slabs or thin strips, i.e. with a thickness ranging from approximately 220 mm for slabs up to several tens of millimeters for thin strip or slabs.

For the purpose of simplification, the under description will focus on slabs as semi-finished product. A slab having the above-described chemical composition is manufactured by continuous casting, and is provided for further processing as per the inventive method of manufacturing. Here, the slab can be used with a high temperature during the continuous casting or may be first cooled to room temperature and then reheated.

The temperature of the slab which is subjected to hot rolling is preferably above the Ac3 point and at least above 1000° C. and must be below 1280° C. The temperatures mentioned herein are stipulated to ensure that at all points in the slab reaches austenitic range. In case the temperature of the slab is lower than 1000° C., excessive load is imposed on a rolling mill, and further, the temperature of the steel may decrease to a ferrite transformation temperature during rolling. Hence to ensure rolling is in complete austenitic zone, reheating must be done above 1000° C. Further the temperature must not be above 1280° C. to avoid adverse growth of austenitic grain resulting in coarse ferrite grain which decreases the capacity of these grains to re-crystallize during hot rolling. Further temperature above 1280° C. enhance the risk of formation of thick layer oxides which are detrimental during hot rolling.

The finishing rolling temperature must be above 800° C. and preferably above 840° C. It is necessary to have finishing rolling temperature above 800° C. point to ensure that the steel subjected to hot rolling is rolled in complete austenitic zone and temperature is sufficiently high at the exit of finishing rolling to have proper scale formation and also to ensure a minimum scale thickness of 5 microns. Final thickness of the hot rolled steel sheet after hot rolling is between 2 mm and 20 mm.

The hot rolled steel sheet obtained in this manner is then cooled with a cooling rate of 2° C./s and 30° C./s to a coiling temperature less than or equal to 650° C. to obtain the requisite constituent of the scale of the present invention. The cooling rate must not be above 30° C./s in order to avoid deterioration in scale formation both in terms of scale constituent and thickness. The coiling temperature must be below 650° C., because above that temperature, there may be a risk of excessive formation of oxygen rich oxides which deteriorates the adhesiveness of the scale as well as detrimental for other mechanical properties such as roughness and ductility of scale layer. The preferred coiling temperature for the hot rolled steel sheet of the present invention is between 550° C. and 650° C. and the preferred cooling rate range after hot rolling is 2 to 15° C./s Subsequently the hot rolled steel sheet is allowed to cool to room temperature with a cooling rate that is preferably not greater than 10° C./s to provide time at temperatures between 450° C. and 550° C. for allowing the magnetite layer with dispersed iron to form in limited oxygen to transform from wustite.

Afterwards, the Hot rolled steel product is cooled at a cooling rate less than 2° C./s to room temperature and preferably the cooling rate after coiling is between 0.0001° C./s and 1° C./s and more preferably the cooling rate after coiling is between 0.0001° C./s and 0.5° C./s. These slow cooling rates are achieved by keeping the coil hot rolled steel product by cooling hot rolled steel product in closed area or under cover. When the hot rolled steel product reaches the room temperature after cooling the high strength steel sheet with excellent scale adhesiveness is obtained.

EXAMPLES

The following tests, examples, figurative exemplification and tables which are presented herein are non-restricting in nature and must be considered for purposes of illustration only, and will display the advantageous features of the present invention and expound the significance of the process parameters chosen by inventors after extensive experiments and further establish the properties that can be achieved by the steel of present invention.

Steel sheets compositions of the test samples are gathered in Table 1, where the steel sheets are produced according to process parameters gathered in Table 2 respectively. Table 3 demonstrates the obtained tertiary scale micro-constituents and table 4 shows the result of evaluations of use properties.

TABLE 1

| Steel compositions | | | | | | | | | | | | | |
|---|---|---|---|---|---|---|---|---|---|---|---|---|---|
| Steel Samples | C | Ni | Cu | Cr | Si | N | S | P | Mo | Nb | V | Ti | B |
| Sample 1 | 0.079 | 0.043 | 0.023 | 0.048 | 0.017 | 0.065 | 0.0035 | 0.011 | 0.0065 | 0.056 | 0.0055 | 0.036 | 0.0002 |
| Sample 2 | 0.079 | 0.042 | 0.041 | 0.043 | 0.019 | 0.065 | 0.0037 | 0.0079 | 0.0070 | 0.073 | 0.0072 | 0.06 | 0.0003 |
| Sample 3 | 0.068 | 0.027 | 0.015 | 0.028 | 0.016 | 0.062 | 0.002 | 0.0081 | 0.0051 | 0.072 | 0.0051 | 0.078 | 0.001 |
| Sample 4 | 0.073 | 0.012 | 0.019 | 0.032 | 0.011 | 0.058 | 0.0032 | 0.016 | 0.0011 | 0.03 | 0.0025 | 0.0017 | 0.001 |

Table 1 is included here only to demonstrate the fact that adhesive scale can be formed on various steel compositions which adhere to the process parameters prescribed by the present invention. These Steel compositions must not be treated as exhaustive in nature as these are merely exemplifying examples.

Table 1 depicts the Steels with the compositions expressed in percentages by weight.

TABLE 2

| Process parameters | | | | | | | | |
|---|---|---|---|---|---|---|---|---|
| Steel Samples | Reheating temperature (° C.) | Finishing temperature (° C.) | Cooling rate before coiling (° C./s) | Thickness (mm) | Time from finishing to coiling (s) | Coiling temperature (° C.) | Cooling rate after coiling (° C./s) | Scale Thickness (microns) |
| Sample 1 | 1250 | 924 | 8.7 | 6 | 39 | 590 | 0.005 | 8.5 |
| Sample 2 | 1220 | 846 | 5.3 | 6 | 35 | 640 | 0.01 | 8.3 |
| Sample 3 | 1220 | 846 | 5.3 | 8 | 33 | 640 | 0.006 | 10.7 |
| Sample 4 | 1250 | 924 | 8.7 | 4 | 30 | 590 | 0.008 | 9.1 |

Table 2 herein details the process parameters implemented on steel samples of Table 1.

TABLE 3

| Micro-constituents of Adhesive Scale | | | | | |
|---|---|---|---|---|---|
| Steel Sample | Magnetite | Ferrite | Wustite | Hematite | Magnetite + Ferrite |
| Sample 1 | 50 | 40 | 9 | 1 | 90 |
| Sample 2 | 40 | 30 | 25 | 5 | 70 |
| Sample 3 | 31 | 25 | 41 | 3 | 56 |
| Sample 4 | 48 | 40 | 12 | 0 | 88 |

Table 3 shows the results of tests conducted in accordance of standards on different microscopes such as Scanning Electron Microscope for determining micro-constituent composition of both inventive and reference adhesive scale.

The results are stipulated in area percentage; it was observed that all invention examples have micro-constituents within the limits prescribed.

TABLE 4

| Mechanical properties | | | |
|---|---|---|---|
| Steel Sample | Scale Adhesion (% reflectivity) | Corrosion Resistance (% of red rust) | Surface cleanliness (% reflectivity) |
| Sample 1 | 85 | 0.2 | 91 |
| Sample 2 | 82 | 1.8 | 86 |
| Sample 3 | 81 | 2.3 | 85 |
| Sample 4 | 84 | 1.1 | 89 |

Table 4 exemplifies the in use properties of the inventive scale. The scale adhesion and the scale cleanliness is tested by the Scotch test wherein in this test the surface cleanliness is measured by applying a tape on the surface that collects the dust and loose scale. This tape is then placed on a white paper and the reflectivity or whiteness is measured. To measure the adhesiveness, an adhesive tape is applied to the entire length of a tensile specimen. This specimen is then gripped in the tensile testing machine and stretched up to 0.2% elongation. The strip is then carefully removed and stuck on a white paper where reflectivity is measured like in the case of surface cleanliness evaluation.

In order to evaluate this resistance to corrosion, a constant humidity test according to NBN EN ISO 6270-2 during 500 h was carried out. After this test, the percentage of red rust present on the surface was evaluated using image analysis software.

Henceforth the outcome of the various mechanical tests conducted in accordance of the standards is tabulated herein:

The examples show that the hot rolled steel sheets according to the invention show all the targeted properties thanks to their specific composition and the micro-constituents of the tertiary scale or the present invention.

What is claimed is:

1. A hot rolled steel product having a composition comprising in percentage by weight:

0.06%≤Carbon≤0.18%
0.01%≤Nickel≤0.6%
0.001%≤Copper≤2%
0.001%≤Chromium≤2%
0.001%≤Silicon≤0.8%
0%≤Nitrogen≤0.008%
0%≤Phosphorus≤0.03%
0%≤Sulfur≤0.03%
0.001%≤Molybdenum≤0.5%
0.001%≤Niobium≤0.1%
0.001%≤Vanadium≤0.5%
0.001%≤Titanium≤0.1%;

and optionally one or more of the following elements:

0.2%≤Manganese≤2%

0.005%≤Aluminum≤0.1%

0% ≤Boron≤0.003%

0% ≤Calcium≤0.01%

0% ≤Magnesium≤0.010%;

a remainder of the composition being composed of iron and unavoidable impurities caused by processing, the product having a tertiary scale layer including, in area fraction, a total amount of at least 50% of magnetite and ferrite, wherein ferrite is at least 25%, 0% to 50% of wustite, and 0% to 10% of hematite, the tertiary scale layer having a thickness between 5 microns and 40 microns.

2. The hot rolled steel product as recited in claim 1 wherein the composition includes 0.01% to 0.5% of silicon.

3. The hot rolled steel product as recited in claim 1 wherein the composition includes 0.1% to 0.3% of nickel.

4. The hot rolled steel product as recited in claim 1 wherein the composition includes 0.1% to 0.5% of copper.

5. The hot rolled steel product as recited in claim 1 wherein the composition includes 0.01% to 0.3% of chromium.

6. The hot rolled steel product as recited in claim 1 wherein the total amount of magnetite and ferrite is greater than or equal to 80% and the percentage of magnetite is higher than 30%.

7. The hot rolled steel product as recited in claim 1 wherein the wustite content is less than or equal to 45%.

8. The hot rolled steel product as recited in claim 1 wherein the hot rolled steel product is a steel sheet having a percentage of red rust, measured according to NBN EN ISO 6270-2, of 20% or less, and a scale adhesiveness of 80% or more.

9. The hot rolled steel product as recited in claim 8 wherein said steel product has a percentage of red rust, measured according to NBN EN ISO 6270-2, of 15% or less, and a scale cleanliness of 80% or more.

10. A method of production of a hot rolled steel product comprising the following successive steps:

providing a semi-finished steel product with a composition comprising in percentage by weight:

0.06%≤ Carbon≤0.18%

0.01%≤Nickel≤0.6%

0.001%≤Copper≤2%

0.001%≤Chromium≤2%

0.001%≤Silicon≤0.8%

0%≤Nitrogen≤0.008%

0%≤Phosphorus≤0.03%

0% 23 Sulfur≤0.03%

0.001%≤Molybdenum≤0.5%

0.001%≤Niobium≤0.1%

0.001%≤Vanadium≤0.5%

0.001%≤Titanium≤0.1%;

and optionally one or more of the following elements:

0.2%≤Manganese≤2%

0.005%≤Aluminum≤0.1%

0% 23 Boron≤0.003%

0%≤Calcium≤0.01%

0% 23 Magnesium≤0.010%;

a remainder of the composition being composed of iron and unavoidable impurities caused by processing;

reheating the semi-finished product to a temperature between 1000° C. and 1280° C.;

rolling the semi-finished product completely in the austenitic range wherein the hot rolling finishing temperature is greater than or equal to 800° C. to obtain a hot rolled steel sheet with thickness between 2 mm and 20 mm;

cooling the hot rolled steel sheet at a cooling rate of 2 to 30° C./s to a coiling temperature less than or equal to 650° C. and coiling the hot rolled steelsheet; and cooling the hot rolled steel sheet to room temperature at a cooling rate less than 2° C./s to obtain the hot rolled steel product as recited in claim 1.

11. The method as recited in claim 10 wherein the coiling temperature is between 550° C. and 650° C.

12. The method as recited in claim 10 wherein the finishing rolling temperature is above 840° C.

13. The method as recited in claim 10 wherein the cooling rate after hot rolling is between 2° C./s and 15° C./s.

14. The method as recited in claim 10 wherein the cooling rate after coiling is between 0.0001° C./s and 1° C./s.

15. The method as recited in claim 10 wherein the cooling rate after coiling is between 0.0001° C./s and 0.5° C./s.

16. The hot rolled steel product as recited in claim 1 wherein the tertiary scale comprises a layer of magnetite, and ferrite is dispersed in the layer of magnetite.

* * * * *